US006000968A

United States Patent [19]

Hagiwara

[11] Patent Number: 6,000,968

[45] Date of Patent: Dec. 14, 1999

[54] SURFACE-MOUNTED CONNECTOR SOCKET

[75] Inventor: Ken Hagiwara, Isesaki, Japan

[73] Assignee: Hosiden Corporation, Osaka, Japan

[21] Appl. No.: 09/144,464

[22] Filed: Sep. 1, 1998

[30] Foreign Application Priority Data

Sep. 9, 1997 [JP] Japan ..... 9-244321

[51] Int. Cl.[6] ..... H01R 13/648

[52] U.S. Cl. ..... 439/607

[58] Field of Search ..... 439/607, 609, 439/610; 200/305; 29/843, 845, 842

[56] References Cited

U.S. PATENT DOCUMENTS

| | | | |
|---|---|---|---|
| 4,457,576 | 7/1984 | Cosmos et al. | 439/610 |
| 5,221,212 | 6/1993 | Davis | 439/108 |
| 5,254,010 | 10/1993 | Davis | 439/108 |
| 5,267,882 | 12/1993 | Davis | 439/680 |
| 5,660,558 | 8/1997 | Osanai et al. | 439/353 |
| 5,733,146 | 3/1998 | Block | 439/610 |

*Primary Examiner*—Neil Abrams
*Assistant Examiner*—Hae Moon Hyeon
*Attorney, Agent, or Firm*—Pollock, Vande Sande & Amernick

[57] ABSTRACT

A shield cover is formed from a single developed metal sheet by folding the metal sheet so as to define a top wall, a bottom wall, upper left hand and right hand side walls extending downwardly from the left and right side edges of the top wall, lower left hand and right hand side walls extending upwardly from the left and right side edges of the bottom wall, and left hand and right hand joint walls connecting the top wall and the bottom wall together at their rear end edges. The upper left hand and right hand side walls and the lower left hand and right hand side walls being in contact with each other. The upper left hand and right hand side walls have left and right legs depending therefrom and extending along the exterior of the lower left hand and right hand side walls to protrude downwardly beyond the bottom wall. A housing of synthetic resin is securely within the shield cover, and a plurality of longitudinally extending connector pins are arrayed in transversely spaced relationship and held in the housing.

8 Claims, 6 Drawing Sheets

SURFACE-MOUNTED CONNECTOR SOCKET

BACKGROUND OF THE INVENTION

This invention relates to a surface-mounted connector socket, more particularly, to a surface-mounted connector socket which is adapted to prevent ingress of solder and flux into the socket when it is mounted to a printed-circuit board by soldering.

An prior art example of the surface-mounted connector socket will be described with reference to FIGS. 1A–3B.

FIG. 1A is an expansion plan view of a shield cover formed of a metallic sheet covering a housing in the prior art example of the surface-mounted connector socket. FIG. 1B is a front view illustrating the shield cover 8 fitted over the housing 6 of the surface-mounted connector socket. FIG. 2A is a rear view illustrating the surface-mounted connector socket. FIG. 2B is a side view illustrating the right hand side of the surface-mounted connector socket. FIG. 2C is a longitudinal cross-sectional view taken across the connector pin of the surface-mounted connector socket. FIG. 3A is a bottom plan view illustrating the surface-mounted connector socket. FIG. 3B is a plan view illustrating the area of the printed-circuit board 7 in hatching where the connector socket is mounted.

The shield cover 8 is formed from a blank metal sheet stamped or cut out as shown in the expansion plan view of FIG. 1A by folding the blank sheet along the dotted lines into a frame-like configuration as shown in FIGS. 1B and 2B, and comprises a top wall 1, a left hand side wall 31, a right hand side wall 32, and a bottom wall 2 composed of a left hand bottom wall portion 21 and a right hand bottom wall portion 22. The left hand bottom wall portion 21 and right hand bottom wall portion 22 are in butting relation with each other at their opposing end edges in the same plane. The left end portion 11 and the right end portion 12 of the top wall 1 are inclined to join the side walls 31 and 32, respectively. The left hand side wall 31 and the right hand side wall 32 have a left leg 311 and a right leg 321, respectively integrally formed therewith which are adapted to be inserted into corresponding through holes of the printed-circuit board 7 (shown in phantom lines in FIG. 1B) to which the shield cover 8 is to be mounted and to be soldered to a ground. The left hand side wall 31 and the right hand side wall 32 are formed adjacent their rear end edges with a left hand lanced and inturned tab 312 and a right hand lanced and inturned tab 322, respectively.

The shield cover 8 is folded and formed in a frame-like configuration as noted above, and a housing 6 of the surface-mounted connector socket is fitted into the shield cover. The housing 6 is formed of synthetic resin and has forced longitudinally thereinto a connector pin 71 comprising a contact portion 71*a*, an intermediate portion 71*b* and a connecting portion 71*c* as shown in FIG. 2C. A number of the connector pins 71 are provided in a horizontal transversely oriented array as seen in FIG. 2A. The housing 6 is mounted to the printed-circuit board 7 by the left hand bottom wall portion 21 and right hand bottom wall portion 22 of the shield cover 8 being securely bonded by soldering to the surface of the printed-circuit board 7, so that the interior of the housing 6 is shielded from the external electromagnetic field.

When the shield cover 8 is folded and formed in a peripheral frame-like configuration, the opposing longitudinally extending end edges of the left hand bottom wall portion 21 and right hand bottom wall portion 22 are in butting relation with each other at the butt region 24 as shown in FIG. 2A. Bonding and securing of the shield cover 8 to the surface of the printed-circuit board 7 is accomplished by soldering the left and right legs 311, 321 and the left and right engaging flaps 211, 221 to the surface of the printed-circuit board 7 with those legs and flaps inserted into the through-holes 741, 742 and 761, 762, respectively formed through the printed-circuit board 7 shown in FIG. 3B.

In the surface-mounted connector socket as described above, since the legs 311, 321 and flaps 211, 221 were formed by striking them from the bottom wall 2 of the shield cover 8 as shown in FIG. 3A, openings 311*a*, 321*a*, 211*a* and 221*a* were cut out in the bottom wall 2 adjoining the printed-circuit board 7. Moreover, since the shield cover 8 was formed by a single metal sheet wrapped around the housing 6 with the opposite end edges butted together on the bottom side of the housing, a gap was formed in the butt region 24 between the left and right hand bottom wall portions 21 and 22 of the shield cover 8 contacting the surface of the printed-circuit board 7. Consequently, when soldering the left and right legs and flaps to the board, solder and flux could intrude into the socket, resulting in degrading the efficiency of the soldering operation and the manufacturing process yields.

SUMMARY OF THE INVENTION

An object of this invention is to provide a surface-mounted connector socket which is adapted to prevent ingress of solder and flux into the socket when it is mounted to a printed-circuit board by soldering.

The surface-mounted connector socket according to this invention comprises:

a generally rectangular peripheral frame-like shield cover formed from a single developed metal sheet stamped in a predetermined shape followed by folding the metal sheet so as to define a top wall, a bottom wall, a pair of upper left hand and right hand side walls, a pair of lower left hand and right hand side walls, and a pair of left hand and right hand joint walls, all interconnected;

a housing of synthetic resin mounted within the rectangular peripheral frame-like shield cover; and a plurality of connector pins arrayed in transversely spaced relationship and held in the housing, the top wall being vertically spaced from and opposing the bottom wall and being connected with the bottom wall at their rear end edges adjacent their left and right sides by the pair of joint walls, the upper left hand and right hand side walls extending downwardly from the left and right side edges, respectively of the top wall, and the lower left hand and right hand side walls extending upwardly from the left and right side edges, respectively of the bottom wall so as to contact with the corresponding upper left hand and right hand side walls, the upper left hand and right hand side walls having left and right legs depending therefrom adjacent the front ends of the side walls and extending along the exterior of said lower left hand and right hand side walls to protrude downwardly beyond the undersurface of the bottom wall.

DETAILED DESCRIPTION OF THE PREFERRED EMBODIMENTS

Embodiments of this invention will be described with reference to FIGS. 4A–6B.

Figure 4A:
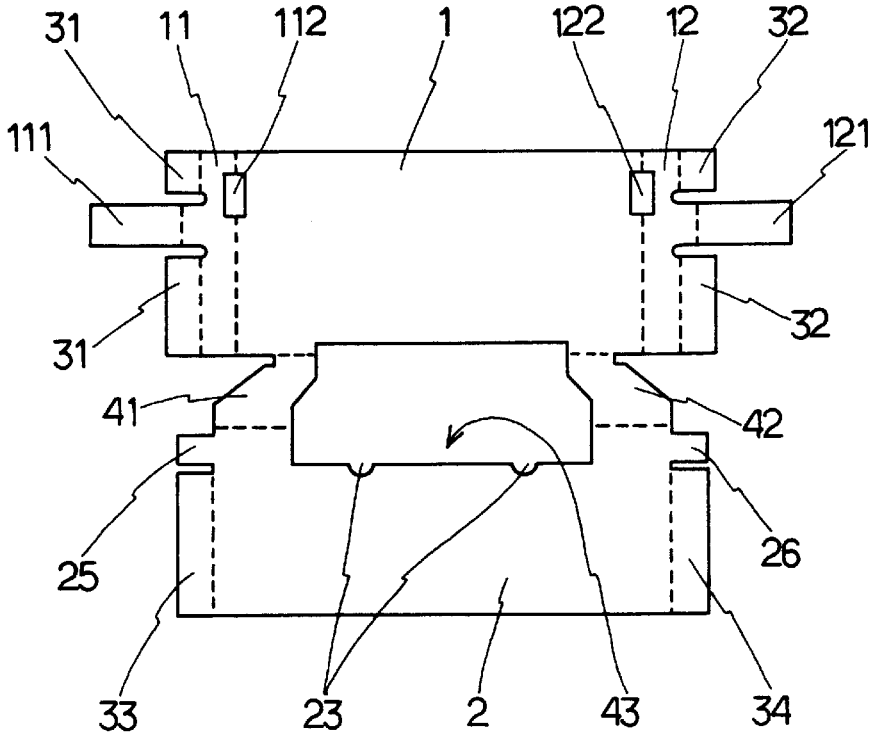
FIG. 4A is an expansion plan view of a shield case according to an embodiment of this invention.
Figure 4B:
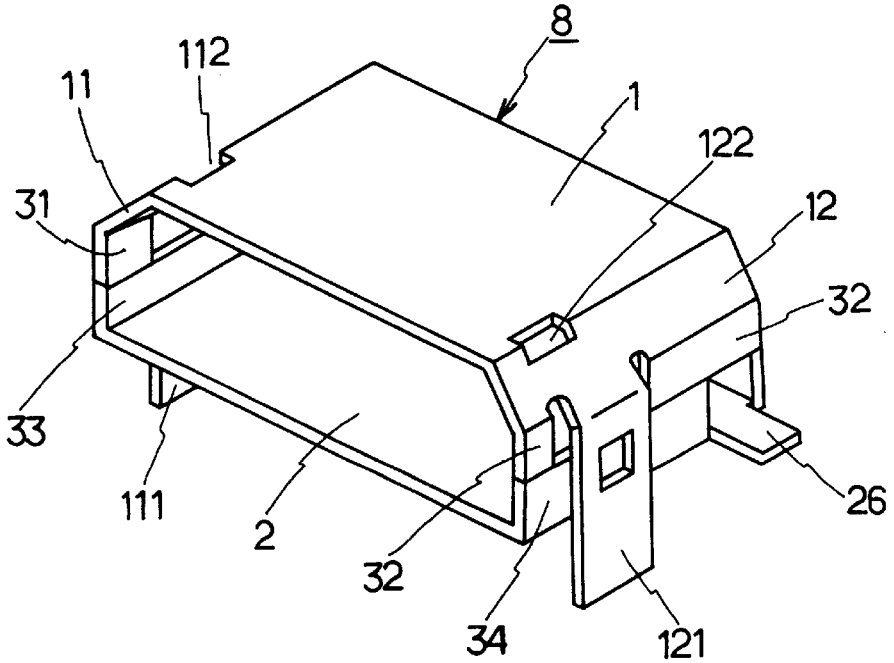
FIG. 4B is a perspective view of the shield case.

FIG. 4A is an expansion plan view of a shield cover for enclosing a housing in an embodiment of the surface-mounted connector socket according to this invention. FIG. 4B is a perspective view of the shield cover formed by folding a single metal sheet having an expansion or development plan view configuration as shown in FIG. 4A along the dotted lines. The shield cover 8 according to this invention is formed from a single metal sheet having a development plan view configuration as shown in FIG. 4A by operating sheet metal working thereon. The thus formed developed metal sheet comprises a top wall 1, a bottom wall 2 approximately equal in size to the top wall, a pair of upper left hand and right hand side walls 31 and 32 extending outwardly from the left and right side edges of the top wall 1, respectively, a pair of lower left hand and right hand side walls 33 and 34 extending outwardly from the left and right side edges of the bottom wall 2, respectively, and a pair of left hand and right hand joint walls 41 and 42 connecting one of the major edges of the top wall 1 and one of the major edges of the bottom wall 2.

Figure 1A:
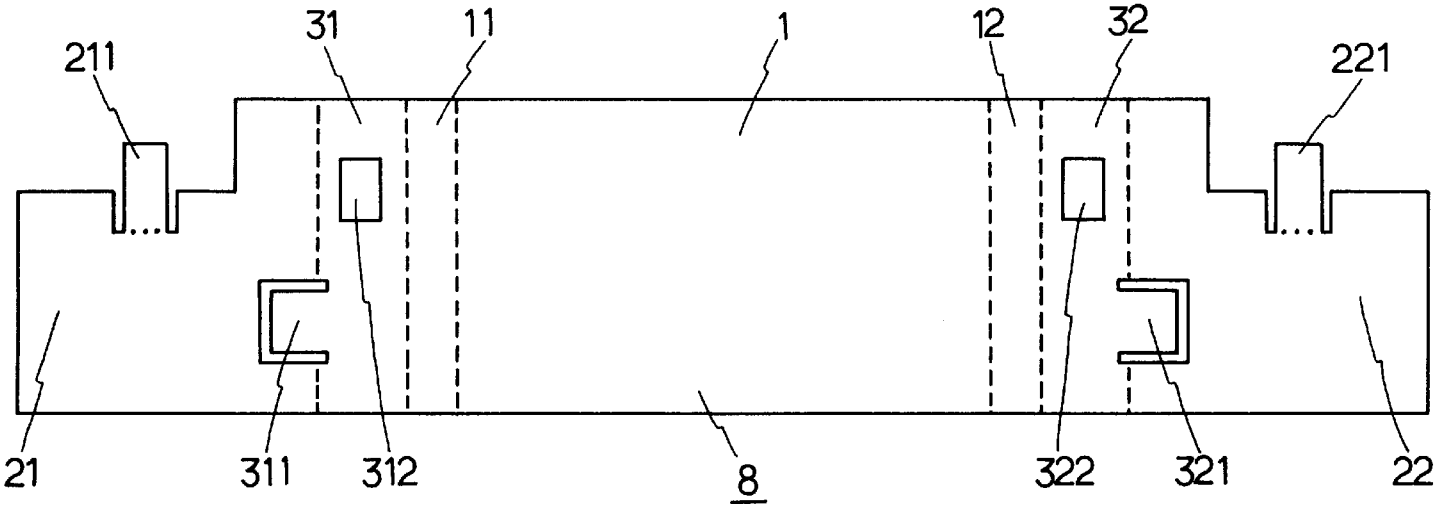
FIG. 1A PRIOR ART
FIG. 1A is an expansion plan view of a shield case in the prior art surface-mounted connector socket.
Figure 1B:
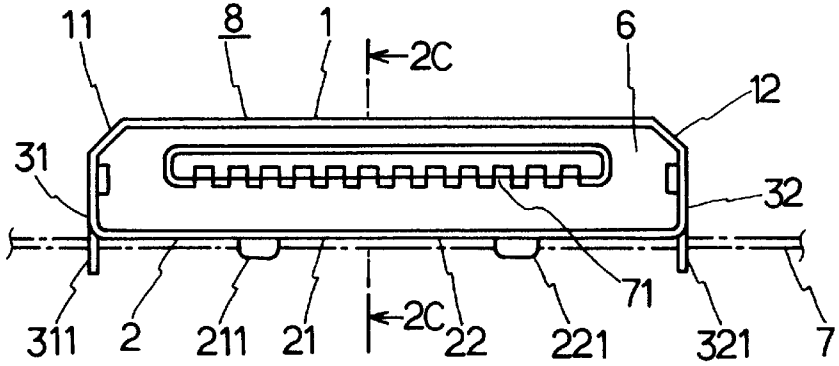
FIG. 1B PRIOR ART
FIG. 1B is a front view of the prior art surface-mounted connector socket.
Figure 2A:
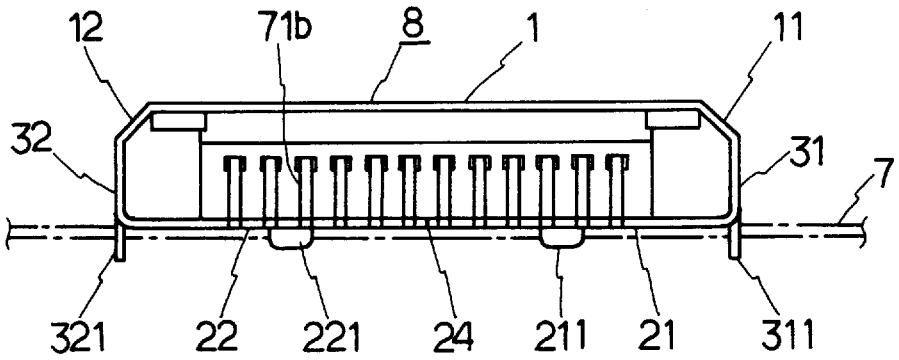
FIG. 2A PRIOR ART
FIG. 2A is a rear view of the prior art surface-mounted connector socket.
Figure 2B:
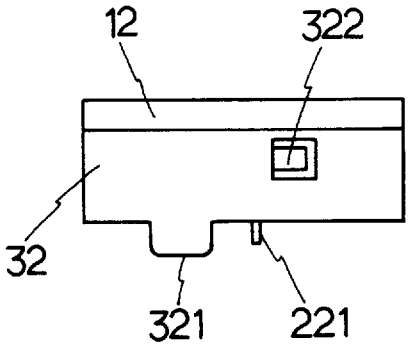
FIG. 2B PRIOR ART
FIG. 2B is a side view of the prior art surface-mounted connector socket.
Figure 2C:
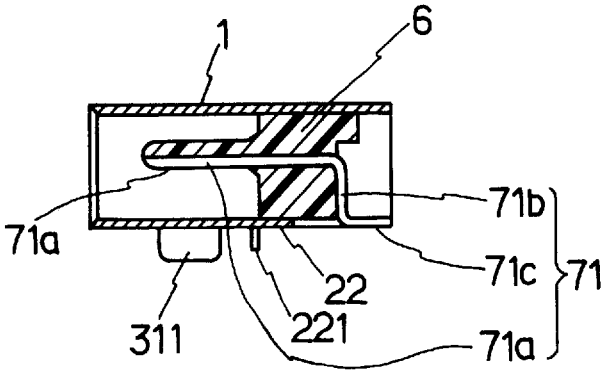
FIG. 2C PRIOR ART
FIG. 2C is a cross-sectional view taken along the line 2C—2C in FIG. 2A.

The top wall 1 has adjacent its left and right side edges and inclined surface defining portions 11 and 12, respectively which define inclined surfaces on the left and right sides of the top wall 1 when the shield cover 8 has been formed as shown in FIG. 4B by folding a developed metal sheet. Left and right legs 111 and 121 extend oppositely and outwardly from those portions (adjacent the front ends of the shield cover) of the left and right inclined surface defining portions 11, 12 remote from the left hand and right hand joint walls 41, 42. Similarly, left and right tongues 25 and 26 extend oppositely and outwardly from the left and right side edges of the bottom wall 2 adjacent the rear end thereof. In addition, a rectangular opening 43 is defined in the major edge of the bottom wall 2 having the left hand and right hand joint walls 41, 42 extending therefrom by a shallow cutout extending into that major edge between the left hand and right hand joint walls 41, 42. The rectangular opening 43 is designed to receive an array of conductor lands 73 on a printed-circuit board 7 shown in FIG. 1B as will be described hereinafter. In that position, the conductor lands 73 are connected by soldering to the corresponding the connecting portions 71*c* of connector pins 71 shown in FIGS. 5C and 6A as will be described below.

The rectangular cutout opening 43 is formed along its inner edge with positioning notches 23. The housing 6 has positioning projections 61 extending downwardly from the undersurface thereof. The positioning projections 61 are adapted to engage the positioning notches 23 to position the housing 6 in place.

The top wall 1 and the bottom wall 2 are connected together at their rear end edges by the left hand and right hand joint walls 41, 42 on the left and right sides, respectively.

A first characteristic feature of this shield cover 8 is that it is formed by folding the shield cover sheet in such manner that the top wall 1 and the bottom wall 2 are each folded by 90° forwardly toward each other so that the left hand and right hand joint walls 41, 42 constitute a part of the rear end wall of the finished shield cover. The upper left hand and right hand side walls 31, 32 and the inclined surface defining portions 11, 12 are likewise folded along the broken lines toward the bottom wall 2 while the lower left hand and right hand side walls 33, 34 are folded along the broken lines toward the top wall 1. Such folding brings the lower end edges of the upper left hand and right hand side walls 31, 32 and the upper end edges of the lower left hand and right hand side walls 33, 34 into end-to-end abutment with each other as shown in FIG. 4B. On the other hand, the left and right legs 111, 121 are folded such that they extend downwardly beyond the bottom wall 2 with the inner surfaces of the legs in contact with the outer surfaces of the lower left hand and right hand side walls 33, 34. Into the peripheral frame-like shield cover 8 formed by folding a metal sheet as described above is a housing 6 of a surface-mounted connector socket inserted as shown in FIGS. 5A, 5B and 5C.

Figure 5A:
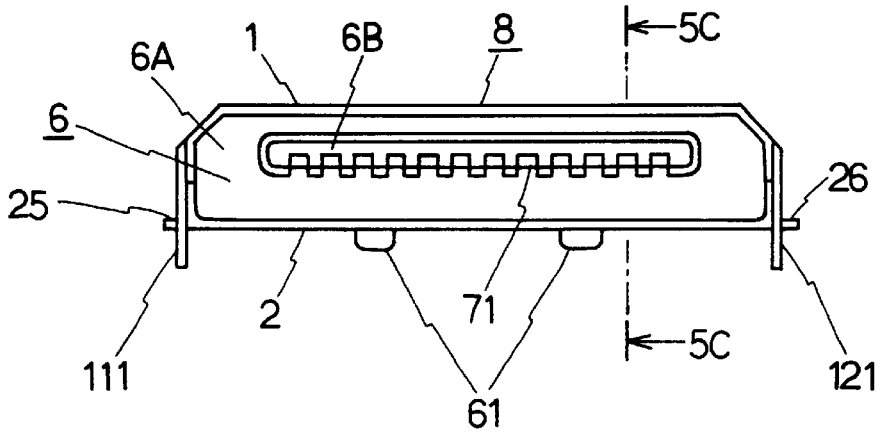
FIG. 5A is a front view of the embodiment of this invention.
Figure 5B:
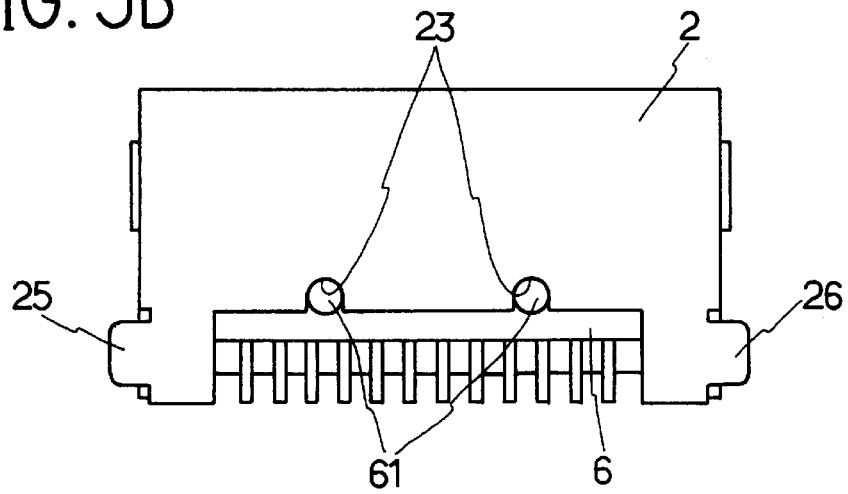
FIG. 5B is a bottom plan view of FIG. 5A.

FIG. 5A is a front view illustrating the shield cover 8 fitted over the housing 6 of the surface-mounted connector socket. FIG. 5B is a bottom plan view illustrating the surface-mounted connector socket. FIG. 5C is a longitudinal cross-sectional view taken along the line 5C—5C passing through the connector pin of the surface-mounted connector socket in FIG. 5A. The housing 6 is formed of synthetic resin and, as shown in FIGS. 5A and 5C, comprises a block-like body 6A adapted to be secured in place in the rear portion of the shield cover 8 and a thin plate-like post 6B extending integrally and forwardly from the front face of the body 6A. The post 6B is formed in its undersurface with transversely spaced and longitudinally extending pin guide grooves 6G corresponding to the array of the connector pins 71 and communicating with through-holes 6H formed in the body 6A.

Figure 5C:
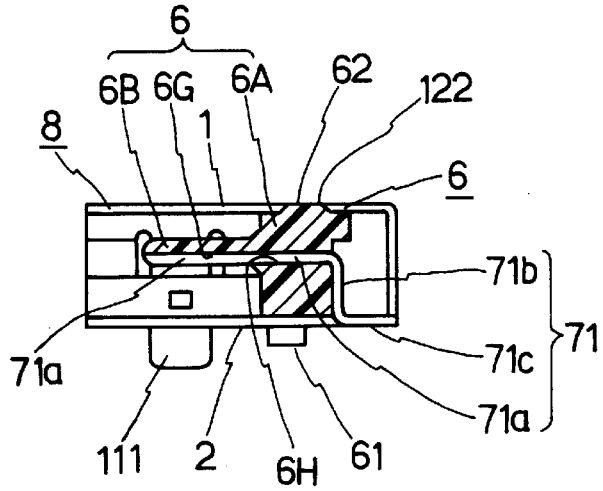
FIG. 5C is a cross-sectional view taken along the line 5C—5C in FIG. 5A.

As shown in FIG. 5C, each of the connector pins 71 comprises a contact portion 71*a*, an intermediate portion 71*b* bent at right angles to the contact portion, and a connecting portion 71*c* bent at right angles to the intermediate portion but in a direction opposite to the contact portion. The contact portions 71*a* of the connector pins 71 extend from the rear face of the body 6A through the respective through-holes 6H and are pressed into the guide grooves 6G to be held in a transverse array.

This housing 6 is shielded from the external electromagnetic field by the shield cover 8 the left and right legs 111, 121 and the left and right tongues 25, 26 are securedly bonded by soldering to the ground formed in the surface of the printed-circuit board 7. The shield cover 8 in the state folded and formed in a frame-like configuration is free from the butt region 24 as well as the cutout openings in the bottom wall 2 as found in the prior art. It is thus to be appreciated that when soldering the shield cover to the board, there is no room for solder and flux to intrude into the interior of the socket.

Figure 6A:
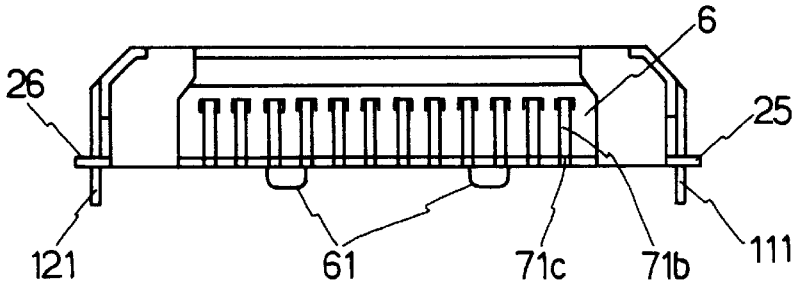
FIG. 6A is a rear view of the embodiment of this invention.
Figure 6B:
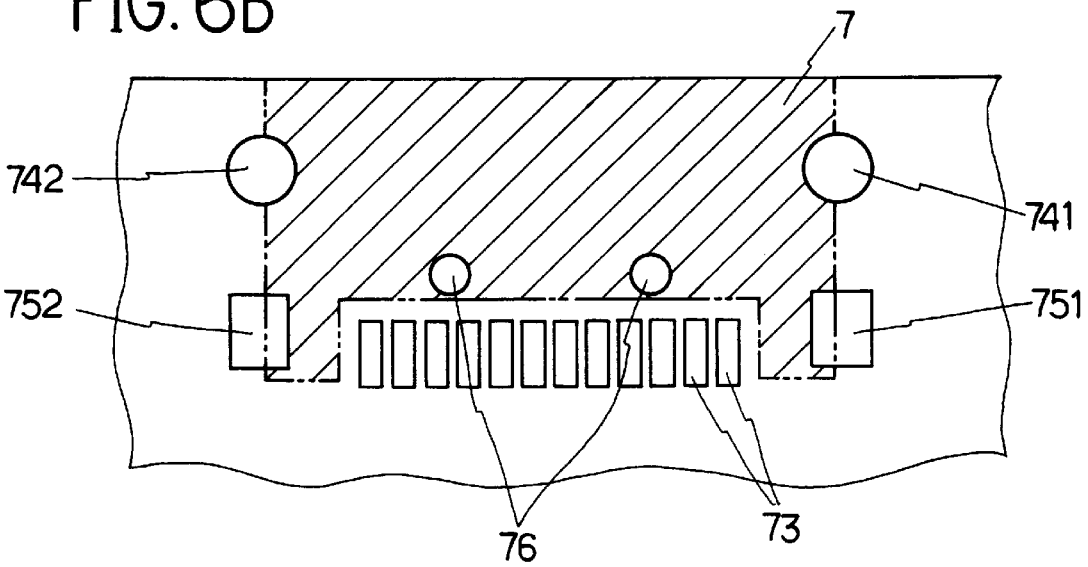
FIG. 6B is a fractional plan view illustrating the area of the printed-circuit board where the connector socket of this invention is surface-mounted.

FIG. 6A is a rear view illustrating the surface-mounted connector socket. FIG. 6B is a plan view illustrating the area of the printed-circuit board 7 where the connector socket is mounted. Bonding and securing of the shield cover 8 to the surface of the printed-circuit board 7 is accomplished by soldering the left and right legs 111, 121 to the printed-circuit board 7 with those legs inserted into the through-holes 741, 742, respectively formed through the printed-circuit board 7 shown in FIG. 6B and soldering the left and right tongues 25, 26 to the grounding lands 751, 752, respectively of the printed-circuit board 7. In this case, the projections 61 extending from the undersurface of the housing 6 are designed to fit in projection receiving apertures 76 formed in the printed-circuit board 7 and to position the housing 6 and shield cover 8 relative to the printed-circuit board 7. A pair of engagement portions 62 formed on the top surface of the housing 6 on the opposite left and right sides thereof are also adapted to fit in a pair of engagement apertures 112 and 122 formed in the top wall 1 of the shield cover 8 to aid in the positioning.

Figure 7:
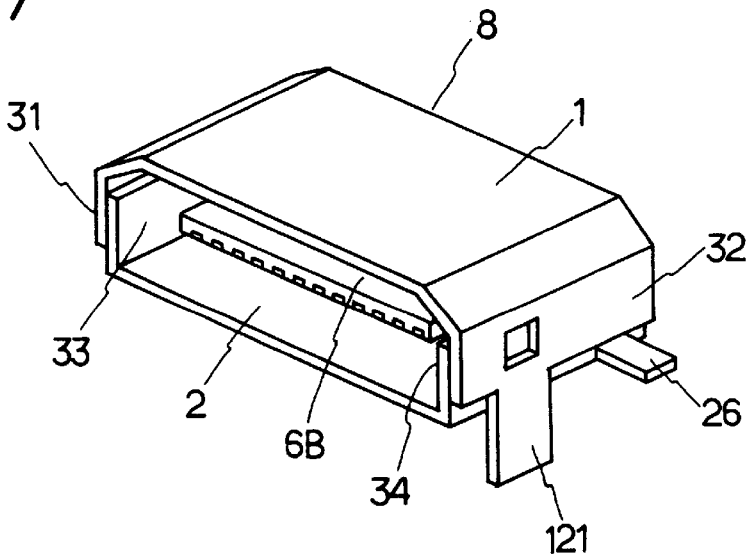
FIG. 7 is a perspective view illustrating another embodiment of this invention.

FIG. 7 is a perspective view illustrating another embodiment of this invention. In the shield cover 8 in this embodiment, the upper left hand and right hand side walls 31, 32 and the lower left hand and right hand side walls 33, 34 are overlapping one on another with the inner surfaces of the former contacting the outer surfaces of the latter. The shield cover 8 is otherwise similar to that of the previous embodiment. Accordingly, further description is omitted. It will be appreciated that with the upper and lower side walls overlapping one on another to form a double-walled construction, the surface-mounted connector socket is mechanically strengthened against the transverse prying forces to which it may be subjected when coupling a connector plug to the connector socket.

EFFECTS OF THE INVENTION

Figure 3A:
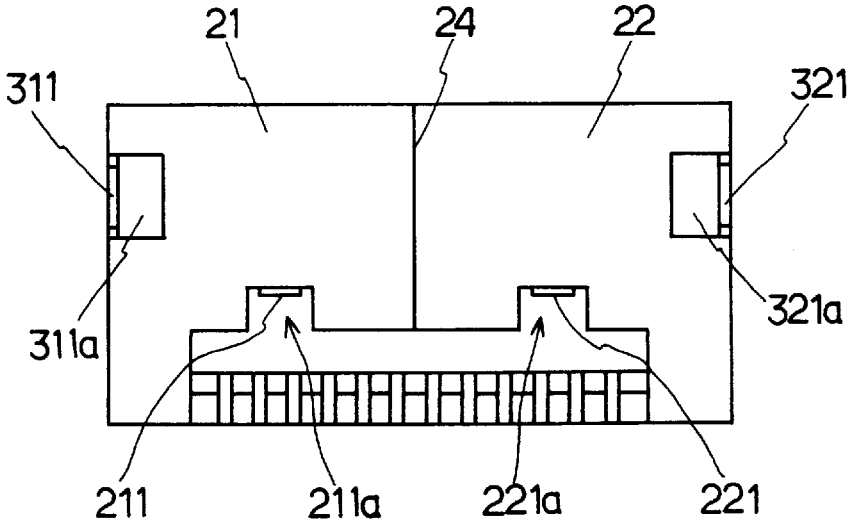
FIG. 3A PRIOR ART
FIG. 3A is a bottom plan view of the prior art surface-mounted connector socket.
Figure 3B:
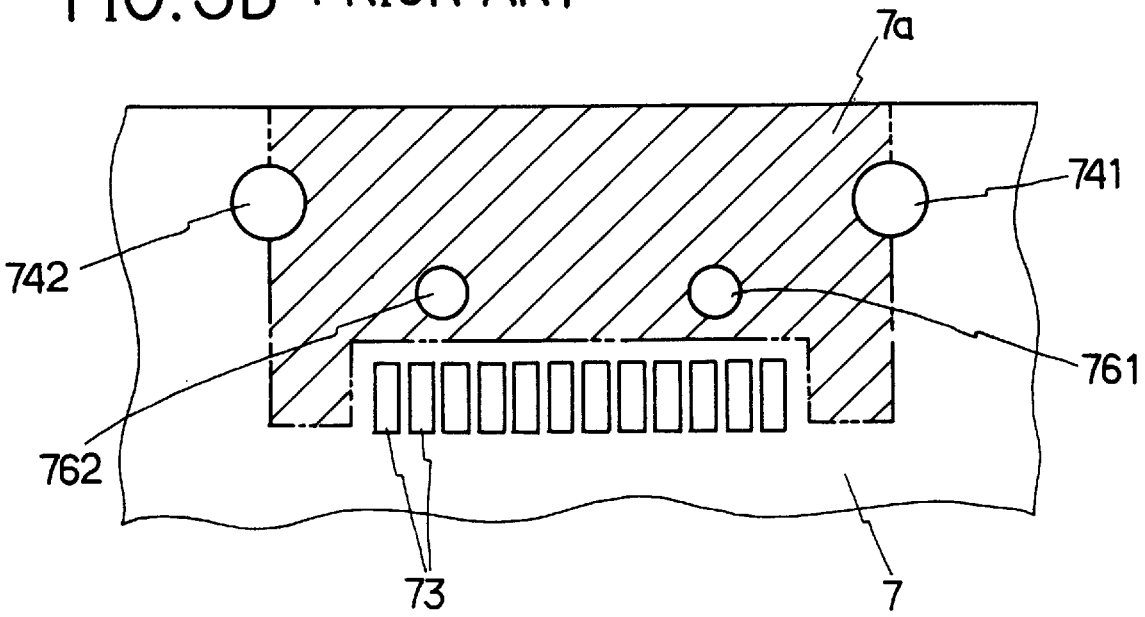
FIG. 3B PRIOR ART
FIG. 3B is a plan view illustrating the area of the printed-circuit board where the prior art connector socket is surface-mounted.

As explained above, according to this invention, no butt region such as the butt region 24 incidental to the prior art exemplified in FIG. 3A is produced in the bottom wall of the shield cover which is to be contacted with the surface-mounted connector socket, by virtue of the shield cover being configured such that the upper left hand and right hand side walls extending downwardly from the top wall and the lower left hand and right hand side walls extending upwardly from the bottom wall meet with each other and such that the left and right legs extend downwardly from the opposite left and right side edges of the top wall and protrude downwardly beyond the bottom wall 2 as they extend along the exterior of the lower left hand and right hand side walls. In addition, the bottom wall is free from openings such as the openings 311*a*, 321*a* produced to form the left and right legs as is the case with the prior art. Accordingly, it is to be understood that when soldering the left and right legs 111, 121 to the printed-circuit board in order to mount the connector socket to the board, no solder or flux may intrude into the interior of the connector socket through openings such as the butt region 24 and the openings 311*a*, 321*a*.

It will also be appreciated that the manufacturing and assembling of the shield cover of this invention is as simple and easy as in the prior art since it may be formed by the very simple process of a single developed metal sheet of a predetermined pattern cut out of a metal sheet stock and folding it as is the case with the prior art.

Besides, in the case where the upper and lower side walls of the shield cover overlapped one on another to form a double-walled construction, it provides for mechanically strengthening the connector socket against the transverse prying forces to which it may be subjected when coupling a connector plug to the connector socket.

Moreover, the connector socket is also mechanically strong against the vertical prying forces to which it may be subjected when coupling a connector plug to the connector socket, the left and right legs to be soldered to the printed-circuit board are formed integrally with the top wall and turned downwardly to extend along the exterior of the lower left hand and right hand side walls so that they may be firmly mechanically secured as well as soldered to the surface of the printed-circuit board.

What is claimed is:

1. A surface-mounted connector socket comprising:

a generally rectangular peripheral frame-shaped shield cover formed from a single developed metal sheet stamped in a predetermined shape followed by folding the metal sheet so as to define a top wall, a bottom wall, a pair of upper left hand and right hand side walls, a pair of lower left hand and right hand side walls, and a pair of left hand and right hand joint walls, all interconnected, said top wall being vertically spaced from and opposing said bottom wall and being connected with said bottom wall at their rear end edges adjacent their left and right sides by said pair of joint walls, said upper left hand and right hand side walls extending downwardly from the left and right side edges, respectively of said top wall, and said lower left hand and right hand side walls extending upwardly from the left and right side edges, respectively of said bottom wall so as to contact with said corresponding upper left hand and right hand side walls, said upper left hand and right hand side walls having left and right legs depending therefrom adjacent the front ends of the side walls and extending along the exterior of said lower left hand and right hand side walls to protrude downwardly beyond the undersurface of said bottom wall;

a housing mounted within said rectangular peripheral frame-shaped shield cover; and a plurality of connector pins arrayed in transversely spaced relationship and held in said housing.

2. The surface-mounted connector socket of claim 1, wherein the lower end edges of said upper left hand and right hand side walls and the upper end edges of said lower left hand and right hand side walls are in end-to-end abutment with each other.

3. The surface-mounted connector socket of claim 1, wherein the interior surfaces of said upper left hand and right hand side walls are in contact with the exterior surfaces of said lower left hand and right hand side walls, respectively.

4. The surface-mounted connector socket of any one of claims 1, 2 and 3, wherein said bottom wall has left and right engaging flaps extending oppositely and outwardly in the same plane from the left and right side edges thereof adjacent the rear ends thereof.

5. The surface-mounted connector socket of any one of claims 1, 2 and 3, wherein said top wall has left and right inclined wall portions slanting from the left and right side edges, respectively to join the upper edges of said left hand and right hand side walls.

6. The surface-mounted connector socket of any one of claims 1, 2 and 3, wherein said bottom wall is formed adjacent the rear end edge thereof with a transversely elongated rectangular cutout opening, said connector pins have connecting portions connected with the rear ends thereof and arrayed in the same plane within said rectangular cutout opening.

7. The surface-mounted connector socket of claim 6, wherein said rectangular cutout opening is formed along its inner edge with positioning notch means, said housing having positioning projection means extending downwardly from the undersurface thereof, said positioning projection means being adapted to engage said positioning notch means to position said housing in place.

8. The surface-mounted connector socket of any one of claims 1, 2 and 3, wherein said housing comprises a block-shaped body secured in place in the rear portion of said shield cover and a thin plate-like post extending forwardly from the front face of said body, said body having a plurality of transversely spaced through-holes longitudinally extending therethrough, said post being formed in one side surface thereof with a plurality of pin guide grooves extending forwardly from the front face of said body and transversely arrayed so as to receive said corresponding connector pins, said connector pins comprising contact portions extending through the respective through-holes and into the guide grooves, intermediate portions bent downwardly along the rear face of said body, and connecting portions bent at right angles to said intermediate portions adjacent said bottom wall and extending rearwardly.

* * * * *